United States Patent [19]

Boggs, Jr.

[11] 4,045,323

[45] Aug. 30, 1977

[54] ANOLYTE SEALING, ELECTRICAL INSULATING FOR ELECTROLYTIC CELLS

[75] Inventor: Frank Boggs, Jr., Baton Rouge, La.

[73] Assignee: BASF Wyandotte Corporation, Wyandotte, Mich.

[21] Appl. No.: 739,078

[22] Filed: Nov. 5, 1976

[51] Int. Cl.[2] ..... C25B 1/26; C25B 9/00; C25B 9/02

[52] U.S. Cl. ..... 204/266; 204/252; 204/279

[58] Field of Search ..... 204/252, 3, 4, 5, 256, 204/7, 8, 279, 284, 286, 263, 266

[56] References Cited

U.S. PATENT DOCUMENTS

| | | | |
|---|---|---|---|
| 3,707,454 | 12/1972 | Loftfield et al. | 204/284 X |
| 3,748,250 | 7/1973 | Schmidt et al. | 204/266 |
| 3,824,173 | 7/1974 | Bouy et al. | 204/284 |
| 3,912,616 | 10/1975 | Ford | 204/286 |

*Primary Examiner*—Arthur C. Prescott
*Attorney, Agent, or Firm*—Norbert M. Lisicki; Bernhard R. Swick; Robert E. Dunn

[57] ABSTRACT

In diaphragm-type electrolytic cells for the production of chlorine and caustic from alkali metal chloride solutions wherein the cell is equipped with one or more metal cathodes and anodes and an electrically conducting and structurally supporting anodic cell base there is provided a novel electrically non-conductive blanket. The anodes are provided with collars at one end thereof and the blanket and cell base are provided with corresponding openings to receive and support the anodes. The blanket openings are provided with an integral lip and shoulder wherein resilient gaskets are disposed around the anode stems and between the lip of the blanket and the collar of the anode.

10 Claims, 1 Drawing Figure

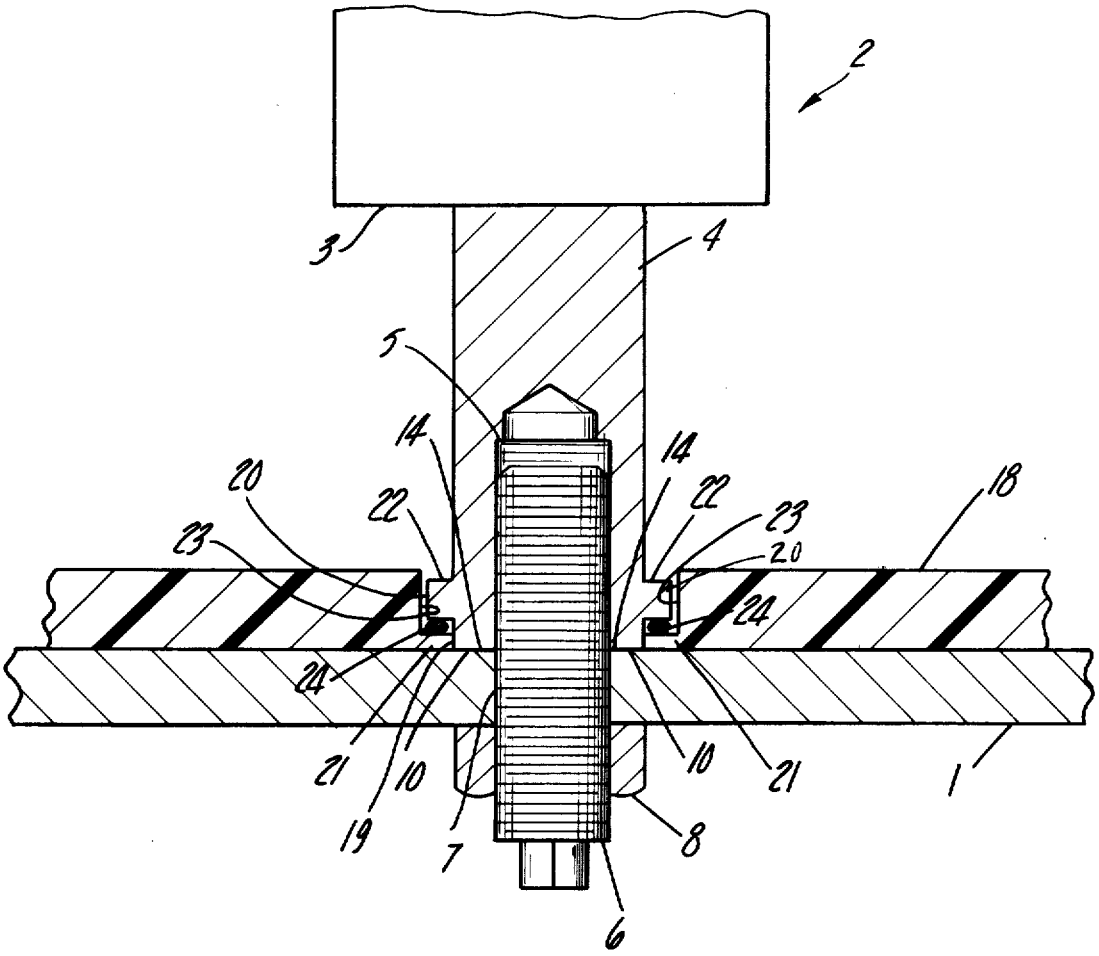
2
3
4
5
14
14
20
22
22
23
23
20
18
24
24
21
10
19
7
10
21
1
8
6

ANOLYTE SEALING, ELECTRICAL INSULATING FOR ELECTROLYTIC CELLS

BACKGROUND OF THE INVENTION

1. Field of the Invention

This invention relates to electrolytic cells and particularly those adapted for the production of chlorine and caustic. More particularly, this invention relates to the cells commonly known in the art as diaphragm type cells. An improved method of keeping the corrosive electrolyte out of the anode connection to the cell base and electrically insulating the anodic cell base from the cathode assembly is provided.

2. Description of the Prior Art

Previous designs for accomplishing this purpose have almost universally employed a large flat section of natural or synthetic rubber or combination thereof as a covering for the cell base. These materials are electrically non-conducting, non-porous, and have sufficient resilience, at least when new, to serve as a gasket to seal the liquid anolyte out of the holes in the sheet through which the anode stems must pass in order to make electrical contact with the anodic cell base. The present design is satisfactory as long as the non-conductive sheet maintains its physical characteristics. However, since the materials are organic they are susceptible to deterioration due to the extremely adverse environmental conditions, e.g., heat and the corrosiveness of the anolyte. This deterioration causes a reduction in the resilience of the sheet allowing the anolyte to leak through onto the anodic cell base resulting in extreme corrosion.

SUMMARY OF THE INVENTION

In accordance with this invention there is provided an improved non-conductive cell blanket for the liquid and electrical insulation of anodic cell bases of diaphragm-type electrolytic cells. This improvement comprises:

a cell base, having one or more openings defined therein and a semi-rigid electrically non-conductive blanket covering said cell base. This blanket has one or more openings defined therein corresponding to the openings in the cell base, with an integral lip and shoulder disposed around each of the openings. The cell includes one or more metal anodes having a collar near one end thereof which end is affixed to the cell base passing through the blanket opening. The collar corresponds to the lip and shoulder in such a manner that a resilient gasket can be disposed around the anode and interposed between the lip and shoulder of the blanket and the collar to form a liquid tight seal.

DESCRIPTION OF THE DRAWING

FIG. 1 is a cross-sectional view of a typical anode installation in an electrolytic cell in accordance with this invention.

DESCRIPTION OF THE PREFERRED EMBODIMENT

Referring now more particularly to the drawing in which the same reference numerals have been applied to various corresponding parts, the apparatus of the present invention includes an electrically conductive structurally supporting cell base 1. At least one, and in most instances a plurality of metal anodes generally indicated at 2 are provided in diaphragm-type electrolytic cells. Since the instant invention would apply in the same manner to each anode, only one anode 2 is shown in relation to cell base 1 in the drawing. Anode 2 preferably comprises a main body portion 3 and at least one support stem 4. This support stem 4 is attached to cell base 1 by means of a threaded stud (bolt) 6 in threaded engagement with a threaded opening 5 in anode stem 4 and extending through opening 7 in cell base 1 and held securely in place by means of a nut 8. The electrical current flow is through anode cell base 1 to machined surface 10 of cell base 1 and across the metal to metal contact into metal anode 2 at its machined surface 14 which has the same physical configuration as surface 10 on cell base 1. To provide both electrical insulation between cell base 1 and the cathode assembly of the cell (not shown), and to provide a physical barrier between cell base 1 and the anolyte liquid in the cell interior, a sheet or blanket 18 of semi-rigid electrically non-conductive material covers the entire surface of cell base 1. Openings 19 are provided in blanket 18 in substantial axial alignment with the openings 7 in cell base 1. Blanket 18 is provided with recesses 20 whereby an integral lip 21 and shoulder 23 is formed around said opening 19. Metal anode 2 is provided with a stem collar 22 which may be integral or separate and affixed thereto by suitable means such as welding. Positioned between lip 21 and shoulder 23 and stem collar 22 is a resilient gasket 24. By tightening nut 8 good metal to metal contact necessary for the desired electrical conductivity at surfaces 10 and 14 is achieved while the compression of gasket 24 between lip 21 and shoulder 23 of blanket 18 and stem collar 22 results in the hydraulic seal needed to prevent leakage of the electrolyte. Grooves or troughs in integral lip 21 or anode stem collar 22 to accomodate gasket 24, while not shown, are preferably included in this invention. The invention resides in the non-conductive blanket 18 providing both electrical insulation between the anodic cell base 1 and the cathode assembly, and, secondly, a physical barrier between the anodic cell base 1 and the anolyte liquid in the cell interior which anolyte liquid is highly corrosive to the anodic cell base 1.

It is preferred in accordance with this invention to employ any and all fiber glass reinforced plastics and any and all inert filled thermosetting plastics as well as any and all inert filled thermoplastics as the material of construction for the non-conducting blanket 18 rather than natural or synthetic rubbers as presently employed. Preferably blanket 18 is constructed of a fiber glass reinforced fluorocarbon polymer and more specifically fiber glass reinforced polytetrafluoroethylene. The non-conductive blanket 18 can be made of any of the well known materials of the prior art, using the knowledge of those skilled in the art. Among these are the polymers of acrylonitrile-butadiene-styrene, styrene-acrylonitrile, acetals, acrylics, alkyds, allylics, fluorocarbons, inomers, polyamides, phenolics, phenylene oxide, polyaryl ether, polyaryl sulfone, polyester, polyethylene, polyimides, polyphenylene sulfide, polypropylene, polystyrene, polysulfone, polyurethane, polyvinyl chloride, polyvinylidene chloride, and vinyl chloride-vinyl acetate. Blanket 18 can be produced by any of the various commercial fabrication methods including hand layup, compression molding, vacuum molding, cold molding, injection molding, etc.

Resilient gasket 24 may be of any elastomeric material which is more resilient than the material employed for the construction of blanket 18. Preferably, gasket 24 is constructed of any of the fluorocarbon elastomers such as polytetrafluoroethylene, polychlorotrifluoroethylene, fluorinated ethylene-propylene polymer, vinylidene fluoride polymer, ethylene trifluoroethylene polymer and ethylene chlorotrifluoroethylene polymer. The actual physical configurations of resilient gasket 24 may be a flat washer, an 0 ring, or any other suitable physical configuration.

The metal anodes 2 are those which are commonly known as dimensionally stable anodes (DSA) and are well known to those skilled in the art. The anode cell base 1 can be constructed of any metal suitable electrically conductive such as steel, copper, aluminum, etc.

It is further contemplated that the weight or volume of fibers or inert filler to the weight or volume of plastic is ratioed in such a manner as to obtain a coefficient of thermal expansion in the non-conductive blanket 18 which is compatible with the coefficient of the thermal expansion of anodic cell base 1. This ratioing of the fibers and/or inerts to the amount of plastic is well within the skill of those skilled in the art. The problem of different rates and extents of thermal expansion between anodic cell base 1 and semi-rigid electrically non-conductive blanket 18 may also be compensated for by providing blanket anode opening 19 with an inside diameter which is somewhat larger than the outside diameter of anode stem 4. Another important concept which is included in this invention is the integral lip 21 and shoulder 23 as part of the non-conductive blanket 18 which protrudes under the anode stem collar and provides a bottom surface for the compression of the resilient gasket 24, thus accomplishing the liquid sealing function.

While not shown in the drawing, grooves or troughs in the integral lip 21 or the anode stem collar 22 may be made to accomodate the resilient gasket 24 either in the 0 ring form or all other similar variations. The physical dimensions of the integral lip 21 and the resilient gasket 24 are not limited to that range which allows for the utilization of this invention with metal anodes 2 currently in use in the chlor-alkali industry without modification to said metal anodes 2. It should be remembered that the vertical dimension of the integral lip 21 of the non-conductive blanket 18 and the resilient gasket 24 need to be controlled. If the combined height in the assembled cell is too thick, i.e., the integral lip 21 plus the compressed resilient gasket 24, then good metal to metal contact will not be obtained between the machined surface 14 on the metal anode stem 4 and the machined surface 10 on the anodic cell base 1. This results in a poor electrical connection which in turn causes a voltage drop and subsequent heat buildup. Similarly, if the combined height is too thin, the resilient gasket 24 will not be compressed enough to provide a tight seal and the corrosive anolyte liquor will leak onto the anodic cell base 1 resulting in its ultimate deterioration. If it is assumed that the standard metal anode 2 has a height of 3/16 inches between the bottom of the anode stem collar 22 and the electrical contact surface 14 on the bottom of the metal anode stem 4 this then means that the total vertical space which can be occupied by the integral lip 21 and the compressed resilient component 24 in the assembled cell is 3/16 of an inch. Thus, one can employ a non-conductive blanket 18 having an integral lip 21 thickness of ⅛ of an inch. When the metal anode 2 is fastened down onto the cell base 1 the resilient gasket 24 would then be compressed to 1/16 of an inch presuming that the non-conductive blanket 18 is considerably more rigid than the resilient gasket 24. This compression is sufficient to provide both a good seal and prevent anolyte liquor leaks at the same time providing for good electrical surface contact.

The horizontal dimensions must also be considered. This is due to the fact that when an elastomeric compound is compressed there is not actual compression (volume change) but merely a volume rearrangement. Therefore, a horizontal gap must be provided between the outside diameter of the uncompressed resilient gasket 24 and the inside diameter of integral retaining shoulder 23 which will allow room for the horizontal spread of the resilient gasket 24 as its vertical height decreases during compression. This item also is well within the purview of those skilled in the art and may be determined readily with a minimum of effort.

Many other modifications and ramifications of this invention will naturally suggest themselves to those skilled in the art based on this disclosure. It is intended that these ramifications and modifications are comprehended as within the scope of this invention.

The embodiments of the invention in which an exclusive property or privilege is claimed are defined as follows:

1. In a diaphragm-type electrolytic cell for the production of chlorine and caustic from alkali metal chloride solutions, the improvement comprising:

a. a cell base, having at least one opening defined therein, b. a semi-rigid electrically non-conductive blanket covering said cell base having at least one opening defined therein corresponding to said opening in said cell base, said blanket having an integral lip disposed around said opening, c. at least one metal anode having a collar near one end thereof corresponding to said lip, said end being affixed to said cell base passing through said blanket opening, and d. a resilient gasket disposed around said anode and interposed between the lip of said blanket and said collar.

2. The cell of claim 1 wherein said blanket is constructed of an inert filler material selected from the group consisting of the polymers of acrylonitrile-butadiene-styrene, styrene-acrylonitrile, acetals, alkyds, allylics, fluorocarbons, ionomers, polyamides, phenolics, phenylene oxide, polyaryl ether, polyaryl sulfone, polyesters, polyethylene, polyimides, polyphenylene sulfide, polypropylene, polystyrene, polysulfone, polyurethane, polyvinyl chloride, polyvinylidene chloride and vinyl chloride-vinyl acetate.

3. The cell of claim 1 wherein said blanket is constructed of fiber glass reinforced fluorocarbon polymer.

4. The cell of claim 1 wherein said blanket is constructed of a material selected from the group consisting of polymers of polytetrafluoroethylene, polychlorotrifluoroethylene, fluorinated ethylene-propylene polymer, vinylidene fluoride polymer, ethylene trifluoroethylene polymer and ethylene chlorotrifluoroethylene.

5. The cell of claim 1 wherein said blanket is constructed of fiber glass reinforced polytetrafluoroethylene.

6. The cell of claim 1 wherein said anode comprises a main body portion and a support stem.

7. The anode of claim 5 wherein said support stem is attached to said cell base by means of a stud.

8. The cell of claim 1 wherein the resilient gasket is constructed of fluorocarbon polymer.

9. The cell of claim 7 wherein the resilient gasket is constructed of a polymer selected from the group consisting polytetrafluoroethylene, polychlorotrifluoroethylene and polyvinylidene fluoride.

10. The cell of claim 8 wherein the resilient gasket is constructed of polytetrafluoroethylene.

* * * * *